US005336834A

United States Patent [19]

Zarchy et al.

[11] Patent Number: 5,336,834

[45] Date of Patent: Aug. 9, 1994

[54] HYDROCARBON CONVERSION WITH ADDITIVE LOSS PREVENTION

[75] Inventors: Andrew S. Zarchy, Amawalk; Chien C. Chao, Millwood, both of N.Y.

[73] Assignee: UOP, Des Plaines, Ill.

[21] Appl. No.: 63,801

[22] Filed: May 20, 1993

[51] Int. Cl.[5] ..... C07C 5/22

[52] U.S. Cl. ..... 585/737; 585/743; 585/748; 585/750; 585/820; 585/823

[58] Field of Search ..... 585/311, 737, 733, 823, 585/950, 743, 748, 750, 820

[56] References Cited

U.S. PATENT DOCUMENTS

| | | | |
|---|---|---|---|
| 4,275,257 | 6/1981 | Hutson, Jr. | 585/741 |
| 4,665,273 | 5/1987 | Johnson et al. | 585/739 |
| 4,786,625 | 12/1987 | Imai et al. | 502/326 |
| 4,831,206 | 3/1988 | Zarchy | 585/737 |
| 4,831,207 | 4/1988 | O'Keefe et al. | 585/737 |
| 4,952,746 | 8/1990 | Johnson et al. | 585/823 |
| 5,164,976 | 11/1992 | Zarchy et al. | 585/823 |

*Primary Examiner*—Anthony McFarlane
*Attorney, Agent, or Firm*—Thomas K. McBride; John G. Tolomei

[57] ABSTRACT

An adsorption arrangement in combination with a catalytic hydrocarbon conversion process suspends non-hydrocarbon materials that act to enhance the operation of the conversion zone by using an adsorption zone arrangement to keep the compounds in recirculation about the reaction zone. The process of this invention is particularly useful for the isomerization of hydrocarbons wherein the adsorption zone arrangement operates to maintain chloride compounds in the reaction zone and to prevent contamination of product streams with the chloride compounds. This invention can be used in combination with traditional adsorptive methods of removing contaminant from feedstreams that enter reaction zones. The invention is also useful for sulfided catalysts where it is desirable to maintain sulfur within the reaction zone and keep sulfur contamination from entering product streams.

22 Claims, 6 Drawing Sheets

HYDROCARBON CONVERSION WITH ADDITIVE LOSS PREVENTION

BACKGROUND OF THE INVENTION

1. Field of the Invention

This invention relates generally to the catalytic conversion of hydrocarbon containing feed streams in the presence of a beneficial material that is dispersible in a hydrocarbon feed and product stream.

2. Description of the Prior Art

Numerous hydrocarbon conversion processes are widely used to alter the structure or properties of hydrocarbon streams. For example, hydrotreating is a common method for the upgrading of feedstocks by the removal of contaminants such as sulfur. Isomerization processes rearrange the molecular structure from straight chain paraffinic or olefinic hydrocarbons to more highly branched hydrocarbons that generally have a higher octane rating or increased utility as substrates for other conversion processes. Hydrocarbon dehydrogenation processes are well known methods of producing olefinic or aromatic substrates. Additional processes include alkylation, transalkylation, reforming and others. Operating conditions and methods for carrying out these process are well known by those skilled in the art. Well known methods for operating such processes include the adsorptive removal of contaminants from feed streams and the desorption of contaminants into resulting effluents or product fractions. U.S. Pat. No. 4,831,206 describes one such arrangement for the adsorption of sulfur compounds and is hereby incorporated by reference.

Many of these processes share the common feature of using a catalyst in the presence of one or more materials that enhance the effectiveness of the catalyst in the reaction zone. These performance enhancing materials can operate in many ways such as increasing or attenuating catalyst activity, neutralizing catalyst poisons, or solubilizing catalyst or feed contaminants. Such performance enhancement materials may be chemically or physically sorbed on the catalyst or dispersed in the hydrocarbon stream.

Where the hydrocarbon product stream leaving a hydrocarbon conversion zone contains the performance enhancing material or beneficent material, methods are sought for preventing contamination of the hydrocarbon product with the beneficent material and the loss of this beneficent material to the product stream. For example light paraffin dehydrogenation catalysts containing platinum, tin and germanium components have their activity attenuated with sulfur compounds. A description of such catalysts can be found in U.S. Pat. No. 4,786,625, the contents of which are hereby incorporated by reference. The effluent from the dehydrogenation zone can carry the sulfur compounds into downstream processes and products. Those skilled in the art will recognize a variety of other process where the materials useful in a catalytic conversion zone degrade products or process operations by their exit from the conversion zone into the effluent streams.

Isomerization of hydrocarbons presents another case where contamination of a catalyst promoter material poses concern. Many isomerization processes employ a highly effective chlorided platinum alumina catalyst system in the reaction zone. The chlorided catalyst requires a continual addition of chloride to replace chloride lost from the surface of the catalyst into the product stream. Hydrogen chloride and/or volatile organic chlorides escape from the process with a stabilizer overhead stream and, apart from the loss of chloride, pose environmental concern. In addition to the loss of chlorides and environmental concerns, chloride loss hinders the operation of chloride promoted isomerization zones in other ways. For example, the recycle of hydrogen or hydrocarbons by a zeolitic adsorption process is not practical when a chloride type catalyst is used unless hydrogen chloride is removed from the recycle stream. Hydrogen chloride produced by the addition of chloride to the reaction zone or released from the catalyst composite results in significant amounts of hydrogen chloride leaving the effluent from the isomerization zone. Contact of this hydrogen chloride with the crystalline alumino-silicates in adsorption or conversion zones will decompose the matrix structure of many crystalline alumino-silicates thereby destroying any catalytic or adsorptive function. Therefore, absent chloride neutralization methods, chlorided catalyst systems generally have insufficient compatibility with many zeolitic catalysts or adsorbents to permit simultaneous use.

A broad object of this invention is to recover and recycle materials which act to enhance the operation of catalytic conversion zones when such materials are carried from the conversion zone by a hydrocarbon effluent stream.

A further object of this invention is to improve methods the reaction of hydrocarbon feed streams with chloride promoted catalyst systems by retaining chloride promoter and minimizing chloride contamination of the product.

A yet further object of this invention is to improve methods for dehydrogenating $C_3$ to $C_5$ feedstreams that use sulfur compounds in combination with a multi-component catalyst in the reaction zone by minimizing sulfur product contamination.

SUMMARY OF THE INVENTION

It has now been discovered that an adsorption arrangement in combination with a catalytic hydrocarbon conversion process will retain nonhydrocarbon materials that act to enhance the operation of the conversion zone by use of an adsorption zone arrangement to keep the compounds in recirculation about the reaction zone. Opposite to conventional methods of protecting catalytic conversion zones by removing contaminants from an adsorption zone input stream through upstream adsorption and regenerating the adsorption zone by downstream desorption, this invention uses the feed stream for upstream desorption to introduce the beneficial material back into the stream and the conversion zone effluent for downstream adsorption to recover the materials. Therefore, instead of using the adsorption zone as a guard bed or a catalyst protection method to keep a material out of a catalytic reaction zone, this invention uses the adsorption zone to keep a beneficial material in the reaction zone, i.e. sustain its concentration level by a desorption-adsorption loop.

As explained in the background of the invention, this invention has application to numerous hydrocarbon conversion processes. A basic requirement for using the process is a hydrocarbon conversion zone that operates in the presence of non-hydrocarbon material which is carried out of the conversion zone by an effluent stream. Examples of effluent transportable materials that enhance the operation of a reaction zone and are susceptible to recovery by the method of this invention include $H_2S$ and HCl.

In order to effect this process, an adsorbent material must have adsorption capacity for the beneficent effluent material in the presence of the hydrocarbon effluent and the input stream must desorb beneficent material from the adsorbent. The invention is not limited to any particular type of adsorbent; any material with the necessary capacity may be used. Preferably, the adsorbent material will recover 90 wt. % and, more preferably, more than 99 wt. % of the beneficent material in the effluent or effluent fraction. The typical adsorbents for use in the invention include molecular sieves, silicalite, silica gels, activated carbon, activated alumina and the like. Reference is made to zeolitic molecular sieves by Donald W. Breck (John Wiley & Sons, 1974) which describes the use and selection of zeolite adsorbents and which is incorporated herein by reference. Of course the adsorption and desorption capacity for the beneficial material must exist under a reasonable range of conditions. Preferably, the process conditions of the input and output stream will compliment the adsorption and desorption requirements of the adsorbent.

In general, operating conditions in many hydrocarbon conversion processes will enhance the operation of this invention. The compatibility of the typical operating conditions of many reaction zone inlet and outlet stream temperatures with the desorption and adsorption stages of this invention advantageously reduces operating costs. A majority of hydrocarbon conversion processes will operate with a relatively hot feed stream and a relatively cooler effluent stream or effluent stream fraction. The temperature differences between the reaction zone inlet stream and the outlet stream or outlet stream fraction provide a high temperature stream for desorption upstream of the reaction zone and a relatively lower temperature stream for downstream adsorption. By using a suitable adsorbent, the instant invention not only provides a means to sustain the level of beneficial material in the reaction zone, but also achieves it with very little utility cost. Endothermic processes provide especially suitable process conditions for the adsorption and desorption cycle wherein the high inlet temperatures facilitate desorption and the low outlet temperatures aid in adsorption. Where the feedstream and/or effluent stream receive one or more stages of heating and cooling, it is possible to select streams having suitable adsorption and desorption temperatures and thereby provide the beneficent material suspension of this invention with a minimum of utility costs. In exothermic processes the utility advantages of this invention are often presented by adsorbing the non-hydrocarbon material from an effluent fraction. In many instances a separation zone will ordinarily split the effluent stream into a relatively cooler overhead stream containing a high concentration of the enhancement material. Adsorbing beneficial material form such effluent fractions will often achieve substantially all of the benefits offered by this invention with a minimum of utility requirements.

This invention is not limited to the recovery and recirculation of a single component about a reaction zone, but may include arrangements for recovery of two or more components. Preferably a single adsorbent material in a single adsorption zone will retain all of the materials to be adsorbed from an effluent stream and desorbed into an inlet stream. Where necessary, multiple adsorbents in a single adsorption zone or multiple adsorption zones (with a single adsorbent material in each zone) may be used to recover the material from the reaction zone effluent stream. In cases of multiple adsorbents the relative selectivity of the adsorbents pose problems of readsorption of one component from the inlet stream that has desorbed the component from an upstream adsorbent. In such cases the feed may be split to separately desorb components from each adsorbent and then recombined downstream of the desorption steps.

In addition to the desorption and adsorption of desirable materials for benefitting the reaction zone, this invention can function concurrently with the adsorption and desorption of reaction zone contaminants. Again in the case of multi-stage heating and cooling of the reaction zone inlet and outlet streams, the adsorption and desorption can often be carried out with a minimal increase in utility requirements. In this manner effecting dual adsorptive and desorptive treatment of inlet and outlet streams with serial adsorption and desorption steps is achieved by varying the adsorption conditions, the adsorbents, or both. Dual adsorptive and desorptive treatment of feed stream particularly benefits processes such as isomerization for the removal of sulfur compounds and the addition of chloride compounds.

Thus, by virtue of this invention applicant has found a use of desorption and adsorptive steps in hydrocarbon conversion that coincide with the needs for recovery of non-reactant materials that benefit the operation of the reaction zone, but economically or operationally impair process operations when taken up by the reaction zone effluent stream. The process has advantages of compatibility with a wide variety of hydrocarbon conversion processes. This compatibility can minimize utility costs by operating at conditions which are in harmony with typical process conditions and existing process steps.

Accordingly in one embodiment this invention is a process for the catalytic conversion of a feedstream comprising hydrocarbons in the presence of a beneficent material that enhances performance of the conversion zone. The process includes the steps of contacting a first stream comprising hydrocarbons with a catalyst in a reaction zone in the presence of a non-hydrocarbon material at hydrocarbon conversion conditions to convert hydrocarbons and produce a second stream comprising hydrocarbons and beneficent material. At least a portion of the second stream passes to an adsorption zone containing an adsorbent having adsorption capacity for the beneficent material where it contacts the second stream with the adsorbent at adsorption conditions to adsorb the beneficent material on the adsorbent and produce an adsorption zone effluent stream having a reduced concentration of non-hydrocarbon material relative to the second hydrocarbon stream. A hydrocarbon feedstream comprising hydrocarbons enters the adsorption zone, after previous adsorption of the beneficent material, at desorption conditions to desorb the beneficent material from the adsorbent and produce at least a portion of the first stream.

In a more limited embodiment, this invention is a process for the isomerization of a hydrocarbon feed containing normal hydrocarbons with a chloride promoted catalyst. The process includes passing a first stream comprising hydrocarbons through a chloride adsorption zone containing an adsorbent for the adsorption of a chloride compound at desorption conditions and desorbing a chloride compound into the first stream to produce a second stream containing normal hydrocarbons and a chloride compound. The second stream passes to an isomerization reaction zone that contacts the second stream with a chloride promoted isomerization catalyst at isomerization conditions to convert normal hydrocarbons to non-normal hydrocarbons and produce an isomerization zone effluent stream. At least a portion of the isomerization zone effluent stream passes to the chloride adsorption zone containing an adsorbent for the adsorption of the chloride compound that adsorbs the chloride compound from the effluent stream for desorption by the first stream ahead of the reaction zone. The process recovers a third stream from the adsorption zone having a reduced concentration of the chloride compound relative to the effluent stream.

Additional details, embodiments and advantages of this invention are disclosed in the following detailed description of the preferred embodiments.

DETAILED DESCRIPTION OF THE PREFERRED EMBODIMENTS

Figure 1:
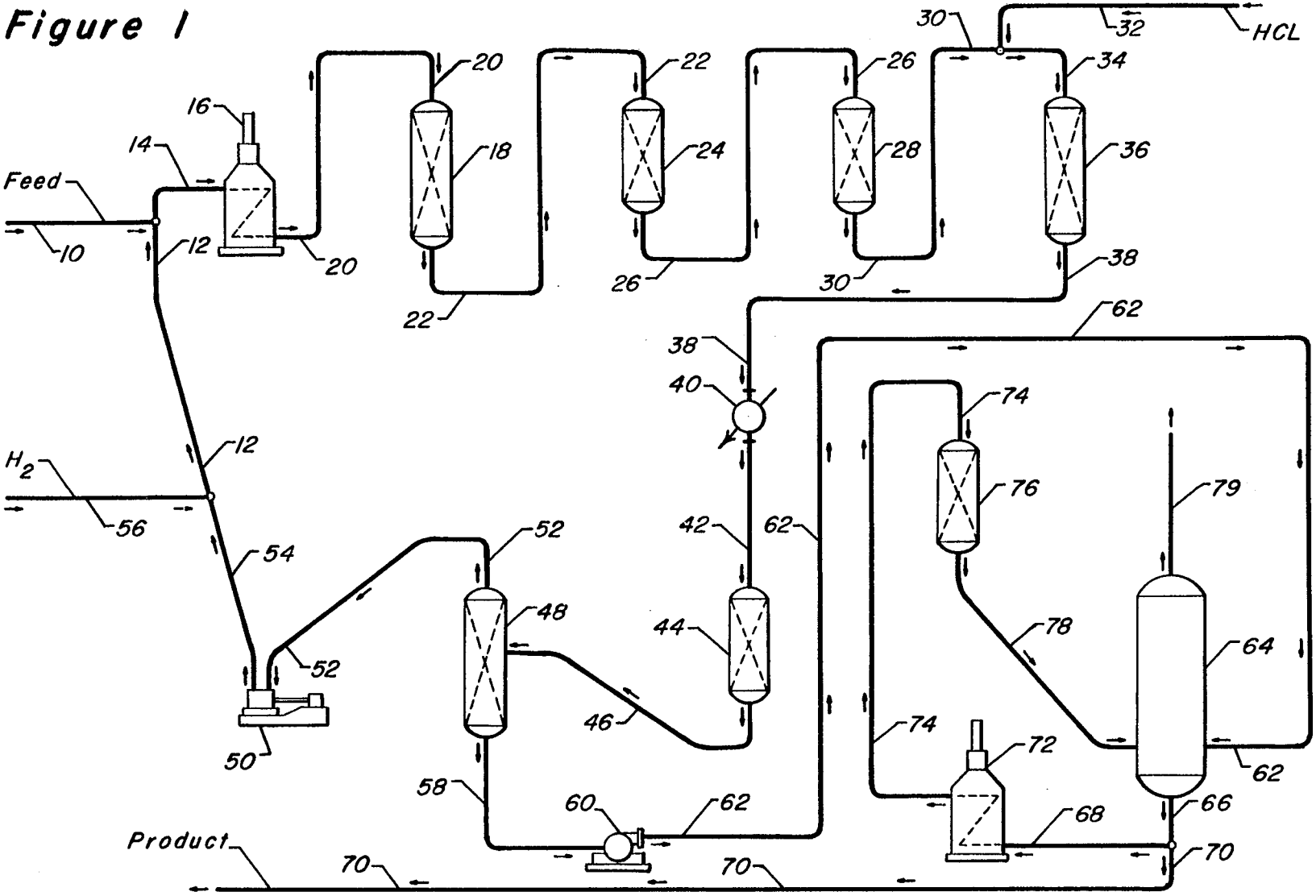
FIG. 1 is a process flow diagram for isomerizing a sulfur containing feed stream comprising hydrocarbons with a chloride promoted catalyst in accordance with this invention.

A preferred embodiment of this invention is in the isomerization of $C_4$–$C_6$ hydrocarbons. The products of isomerization processes contribute to a gasoline blending pool. Such gasoline blending pools normally include $C_4$ and heavier hydrocarbons having boiling points of less than 205° C. (395° F.) at atmospheric pressure. This range of hydrocarbon includes $C_4$–$C_7$ paraffins and especially the $C_5$ and $C_6$ normal paraffins which have relatively low octane numbers. The $C_4$–$C_6$ hydrocarbons have the greatest susceptibility to octane improvement by lead addition and were formerly upgraded in this manner. Octane improvement is now often obtained by using isomerization to rearrange the structure of the straight-chain paraffinic hydrocarbons into branch-chained paraffins.

Preferred feedstocks are rich in normal paraffins having from 4 to 6 carbon atoms or a mixture of such substantially pure normal paraffins. The term "rich" is defined to mean a stream having more than 50% of the mentioned component. Other useful feedstocks include light natural gasoline, light straight run naphtha, gas oil condensate, light raffinates, light reformate, light hydrocarbons and straight run distillates having distillation end points of about 77° C. (170° F.) and containing substantial quantities of $C_4$–$C_6$ paraffins. The feed stream may also contain low concentrations of unsaturated hydrocarbons and hydrocarbons having more than 7 carbon atoms. The concentration of these materials should be limited to 10 wt. % for unsaturated compounds and 20 wt. % for heavier hydrocarbons in order to restrict hydrogen consumption and cracking reactions.

The isomerization of paraffins is generally considered a reversible first order reaction. The reaction is limited by thermodynamic equilibrium. The most common types of catalyst systems that are used in effecting the reaction are hydrochloric acid promoted aluminum chloride systems and supported aluminum chloride catalysts. The isomerization reaction zone typically contains a fixed bed of a chloride promoted isomerization catalyst. In the expectation that the feedstock will contain some olefins and, therefore, will undergo at least some cracking, the catalyst is preferably combined with an additional catalyst component that will provide a hydrogenation-dehydrogenation function. Preferably, this component is a noble metal of Group VIII of the periodic classification of the elements which are defined to include ruthenium, rhodium, platinum, osmium, iridium and palladium, with these specific metals being also known as the platinum group metals. The catalyst composition can be used alone or can be combined with a porous inorganic oxide diluent as a binder material. Other suitable binders include alumino-silicate clays such as kaolin, attapulgite, sepiolite, polygarskite, bentonire and montmorillonite, when rendered in a pliant plastic-like condition by intimate admixture with water, particularly when the clays have not been acid washed to remove substantial quantities of alumina.

Of these chlorided catalyst systems a particularly preferred type of catalyst consists of a high chloride catalyst on an alumina base containing platinum. The alumina may be selected from various forms including an anhydrous gamma-alumina with a high degree of purity. The catalyst may also contain other platinum group metals. These metals demonstrate differences in activity and selectivity such that platinum is the preferred metal for use in such catalysts. The catalyst will contain from about 0.1–0.25 wt. % platinum. Other platinum group metals may be present in a concentration of from 0.1–0.25 wt. %. The platinum component may exist within the final catalytic composite as an oxide or halide or as an elemental metal. The presence of the platinum component in its reduced state has been found most suitable for this purpose. The catalyst also contains the chloride component. The chloride component termed in the art "a combined chloride" is present in an amount from about 2 to about 10 wt. % based upon the dry support material. The use of chloride in amounts greater than 5 wt. % have been found to be the most beneficial in these catalysts.

There are a variety of ways for preparing a chlorided catalytic composite and incorporating a platinum metal and chloride therein. The method that has shown the best results impregnates the carrier material through contact with an aqueous solution of a water-soluble decomposable compound of the platinum group metal. For best results, the impregnation is carried out by dipping the carrier material in a solution of chloroplatinic acid. Additional solutions that may be used include ammonium chloroplatinate, bromoplatinic acid or platinum dichloride. Use of the platinum chloride compound serves the dual function of incorporating the platinum component and at least a minor quantity of the chloride into the catalyst. Additional amounts of the chloride must be incorporated into the catalyst by the addition or formation of aluminum chloride to or on the platinum-alumina catalyst base. An alternate method of increasing the chloride concentration in the final catalyst composite is to use an aluminum hydrosol to form the alumina carrier material such that the carrier material also contains at least a portion of the chloride. Chloride may also be added to the carrier material by contacting the calcined carrier material with an aqueous solution of the chloride such as hydrogen chloride.

When a chlorided catalyst is used, operation of the isomerization zones often uses a small amount of a chloride promoter. The chloride promoter, typically an organic chloride serves to maintain a high level of active chloride on the catalyst as low levels are continuously stripped off the catalyst by the hydrocarbon feed. The concentration of promoter in the reaction zone is maintained at from 30–300 ppm. The preferred promoter compound is carbon tetrachloride. Other suitable promoter compounds include oxygen-free decomposable organic chlorides such as propyldichloride, butylchloride, and chloroform to name only a few of such compounds. The need to keep the reactants dry is reinforced by the presence of the organic chloride compound which may convert, in part, to hydrogen chloride. As long as the process streams are kept dry, there will be no adverse effect from the presence of small amounts of hydrogen chloride.

These chloride promoted catalysts are very reactive and can generate undesirable side reactions such as disproportionation and cracking. These side reactions not only decrease the product yield but can form olefinic fragments that polymerize or deposit on the catalyst and shorten its life. One commonly practiced method of controlling these undesired reactions has been to carry out the reaction in the presence of hydrogen.

In accordance with this invention, an adsorption zone recovers the chloride that the feed strips from the catalyst. The effluent from the reaction zone contacts an adsorbent having a capacity for chloride compounds. The principle of the instant invention can be implemented with many different adsorbents such as zeolites, clays, inorganic polymers such as activated alumina, silica gel, zirconia, carbon, organic polymers such as resin adsorbent, etc. Not as a limitation on the scope of the process of this invention, but as a further discovery of preferred adsorbents, it has been found that ion-exchanged clinoptilolites particularly, NaK clinoptilolite, acid washed Ba clinoptilolite, MgK clinoptilolite, acid leached clinoptilolite, $NH_4$ clinoptilolite, etc. are particularly suitable for recycling HCl. Clinoptilolite as an adsorbent with adjustable pore size and acid resistance is described in U.S. Pat. No. 4,935,580 issued to Chao et al., U.S. Pat. No. 4,964,889 issued to Chao, and U.S. Pat. No. 5,164,076 issued to Zarchy, Chao and Correia, the contents of which are hereby incorporated by reference. For NaK and MgK clinoptilolite, the preferred concentration of potassium ions is in the range of 15 to 75%, and more preferably in a range of 30 to 70%, and the concentration of Na and Mg are preferably in a range of 25 to 85% and more preferably in a range of 30 to 70%. The sum of Na and K or Mg and K are in the range of 50 to 100% of the total ion exchange capacity of the adsorbent. For Ba clinoptilolite, the barium concentration should be in the range of 20 to 100% of the ion exchange capacity. Other useful compositions include K, Na, Li, H, Mg, Ca, Sr, Zn, Mn, Co, CaK, SrK, ZnK, MnK, CoK and BaK cation exchanged or naturally occurring clinoptilolites and their acid washed version with the intended cations accounting for 50 to 100% of the total ion-exchange capacity of the clinoptilolite.

The most important factor in obtaining suitable clinoptilolite materials for the adsorption of HCl compounds is the adjustment of the adsorbent pore size. In most cases, the changes in the pore size of zeolites following ion-exchange are consistent with a physical blocking of the pore opening by the cation introduced. In general, in any given zeolite, the larger the radius of the ion introduced, the smaller the effective pore diameter of the treated zeolite (for example, the pore diameter of potassium A zeolite is smaller than that of sodium A zeolite), as measured by the size of the molecules which can be adsorbed into the zeolite.

Such is not the case, however, with clinoptilolites which demonstrate an unpredictable relationship that is not a simple function of the ionic radius of the cations introduced, i.e., pore blocking. For example potassium cations, which are larger than sodium cations, provide a clinoptilolite having a larger effective pore diameter than sodium ion-exchanged clinoptilolite. Sodium has an ionic radius of 0.98 Å versus 1.33 Å for potassium. See F. A. Cotton, G. Wilkinson, *Advanced Inorganic Chemistry*, Interscience Publishers (1980) or the *Handbook of Chemistry and Physics*, 56 Edition, CRC Press (1975) at pg. F-209, said references hereby incorporated by reference. In fact, a sodium ion-exchanged clinoptilolite with a sodium content equivalent to about 90% of its ion-exchange capacity defined by its aluminum content essentially excludes both hydrogen sulfide and n-butane. On the other hand, a potassium ion-exchanged clinoptilolite with a potassium content equivalent to about 95% of its ion-exchange capacity adsorbs hydrogen sulfide rapidly but substantially excludes n-butane. Thus, the clinoptilolite containing the cation with the larger ionic radius, i.e., potassium, has a larger pore than the clinoptilolite containing the cation with the smaller ionic radius, i.e., sodium.

The clinoptilolites used in the process of the present invention may be natural or synthetic clinoptilolites. Natural clinoptilolites are preferred because they are currently readily available in commercial quantities. However, natural clinoptilolites are variable in composition and chemical analysis shows that the cations in clinoptilolite samples from various mines and even within a single deposit can vary widely. Moreover, natural clinoptilolites frequently contain substantial amounts of impurities, especially soluble silicates, which may alter the adsorption properties during activation, or may cause undesirable side effects which may inhibit practicing this invention. As an example of the compositional variations in natural clinoptilolites, the following Table 1 sets forth the chemical analysis of several clinoptilolite ore samples.

TABLE 1

| Ore No. | 1 | 2 | 3 | 4 | 5 |
|---|---|---|---|---|---|
| Source No. | 1 | 2 | 3 | 2 | 1 |
| Wt. % dry basis | | | | | |
| $SiO_2$ | 76.37 | 76.02 | 75.24 | 76.67 | 76.15 |
| $Al_2O_3$ | 12.74 | 13.22 | 12.62 | 13.95 | 12.90 |
| MgO | 0.55 | 0.77 | 2.12 | 0.76 | 0.33 |
| CaO | 0.55 | 2.19 | 2.72 | 2.27 | 1.04 |
| $Na_2O$ | 3.86 | 3.72 | 2.25 | 3.26 | 4.09 |
| $K_2O$ | 4.21 | 2.11 | 2.17 | 1.93 | 4.08 |
| Other* | 1.72 | 1.98 | 2.88 | 1.16 | 1.41 |
| | 100.00 | 100.00 | 100.00 | 100.00 | 100.00 |
| Elemental | | | | | |

TABLE 1-continued

| Ore No. | 1 | 2 | 3 | 4 | 5 |
|---|---|---|---|---|---|
| Source No. | 1 | 2 | 3 | 2 | 1 |
| Concentration mmol/gm | | | | | |
| Si | 12.73 | 12.67 | 12.54 | 12.78 | 12.69 |
| Al | 2.50 | 2.59 | 2.47 | 2.74 | 2.53 |
| Mg | 0.14 | 0.19 | 0.53 | 0.19 | 0.08 |
| Ca | 0.10 | 0.39 | 0.49 | 0.41 | 0.19 |
| Na | 1.25 | 1.20 | 0.73 | 1.05 | 1.32 |
| K | 0.89 | 0.45 | 0.46 | 0.41 | 0.87 |

*Includes the following oxides: $Fe_2O_3$, SrO, BaO

It can be seen from Table 1 that the concentrations of the various cations of the ore samples can vary quite substantially, especially when considered in view of the total theoretical ion-exchange capacity based on aluminum content. Note, for instance, the calcium content which varies from about 8 equivalent percent in Ore No. 1 to about 40 equivalent percent in Ore No. 3, e.g., for Ore No. 1, using the cation concentrations, $Ca \times 2/Al \times 100 = \%$, $0.10 \times 2/2.5 \times 100 = 8.0\%$. Similarly, the potassium content varies from 15.0 equivalent percent in Ore No. 4 to 35.6 equivalent percent in Ore No. 1. With respect to cations present in relatively small amounts such as, barium or strontium, the variations are generally not significant.

Often, due to the above-described compositional variations, it is desirable to treat the natural clinoptilolite with a thorough ion-exchange to create a uniform starting material. For this initial ion-exchange, it is important to use a cation of reasonably high ion-exchange selectivity so it can effectively displace a substantial portion of the variety of cations originally existing in the natural zeolite. However, it is also important to not use a cation of overly high selectivity, otherwise it would make further tailoring of the adsorption properties of the clinoptilolite by ion-exchange difficult. The cations suitable to provide compositional uniformity in accordance with the present invention include sodium, potassium, calcium, lithium, magnesium, strontium, zinc, copper, cobalt, and manganese. It is often economically advantageous, and preferred, to use sodium or potassium for this purpose. The ion-exchanged clinoptilolite can then be further ion-exchanged with other cations, e.g., barium cations, to establish the desired level. It is, of course, possible to ion-exchange the clinoptilolite directly with cations other than set forth above, e.g., barium cations, without an initial ion-exchange.

Clinoptilolite typically loses some of its adsorption capacity for HCl after adsorbing and desorbing HCl. However, the rate of loss slows drastically after the first few cycles. It has been found that NaK clinoptilolite, acid washed Ba clinoptilolite, MgK clinoptilolite, acid leached clinoptilolite (or H clinoptilolite) and acid washed $NH_4$ clinoptilolite all retain a substantial amount of HCl capacities after repeated adsorption and desorption. One reason for the loss of HCl capacity after repeated cycles is the reaction of clinoptilolite cations with HCl to form chloride salt. In some cases, HCl washing to remove such chloride salt in the adsorbent manufacturing stage is helpful in providing a product that minimizes the phenomena of chloride salt formation and has a higher steady state HCl capacity.

The type and concentration of hydrocarbons present in the feedstream are not critical to performing the process but can influence the performance somewhat. Preferably, the hydrocarbons will be present in the carbon range of from about 4 to about 12 carbon atoms per molecule. Ethane and propane are often by-products produced by catalytic hydrocarbon conversion processes. The adsorbent should have a low capacity for these small hydrocarbon impurities. NaK clino, acid washed Ba clinoptilolite, and MgK clinoptilolite, as previously described, have suitably low capacity for $C_3$ and lighter hydrocarbons and are preferred adsorbents. Acid washed clinoptilolite has a somewhat higher $C_3$ capacity and is less preferred.

A fixed bed retains the adsorbent in the adsorption zone for contact with the input and effluent streams from the reaction zone. The adsorption zone preferably contains two or more adsorbent beds to continuously adsorb and desorb material from the effluent and the input stream. Typical conditions for operation of the adsorbent zones will again depend upon the particular adsorbents used and the temperature and pressure conditions of the inlet and effluent stream from the reaction zone. Typical conditions will include temperatures from 50°-750° F. and pressures of from 1 atmosphere to 50 atmospheres and the feedstream can contact the adsorbent in vapor or liquid phase conditions. Preferably, the processing conditions will maintain the feedstream through the adsorption zone in a vapor phase.

Adsorbents should be selected to correspond with the temperature conditions in the isomerization zone. When contacting the catalyst in the reaction zone, the feed is heated as necessary to achieve the desired reaction temperature and then enters the isomerization reaction zone. Operating conditions within the isomerization zone are selected to maximize the production of isoalkane product from the feed components and are influenced by the type of catalyst as well as the composition of the feed. Two reaction zones are typically provided due to a temperature rise that initially occurs from hydrogenation reactions. Conditions within the first isomerization zone typically include a temperature in the range of 190°-290° C. (375°-550° F.), a pressure of from 1200-3100 kPag (175-450 psig) and a liquid hourly space velocity of from 4-20. Typically, the reaction conditions are selected to keep the hydrocarbon feed in a vapor or mixed phase. Temperatures within the second conversion zone will usually operate at somewhat lower temperatures and range from about 65°-280° C. (150°-536° F.). These lower temperatures are particularly useful in processing feeds composed of $C_5$ and $C_6$ paraffins where the lower temperatures favor equilibrium mixtures having the highest concentration of the most branched paraffins. When the feed mixture is primarily $C_5$ and $C_6$ paraffins, temperatures in the range of from 65°-160° C. (150°-320° F.) are preferred. When it is desired to isomerize significant amounts of $C_4$ hydrocarbons, higher reaction temperatures are required to maintain catalyst activity. Thus, when the feed mixture contains significant portions of $C_4$-$C_6$ paraffins most suitable operating temperatures are in the range from 140°-235° C. (280°-455° F.). The second conversion zone may be maintained over the same range of pressures given for the first conversion zone. The feed rate to the second conversion zone may also vary over a wide range but will usually include liquid hourly space velocities that are lower than the first conversion zone and range from 0.5-12 $hr.^{-1}$, with space velocities of between 1 and 8 $hr.^{-1}$ being preferred. The hydrogen concentration in the second conversion zone may also be adjusted by the addition of hydrogen to the feed or to the second conversion zone. The particular operating conditions within the isomerization zone will also be influenced by the makeup of the feed stream and the catalyst composition employed therein.

Side reactions within the isomerization zone, particularly the saturation of unsaturates, will raise the temperature of the effluent from the first conversion zone. For example, the effluent from the first conversion zone can increase by 20° F. for each percentage point of benzene that is present in the entering feed. As a result of the increased temperature, the effluent from the first conversion zone is cooled in order to return it to a more desired isomerization temperature before it enters the second conversion zone. Even where there is not a substantial heat addition in the first conversion zone, it is often desirable to operate the second conversion zone in a two-stage isomerization process, at a lower temperature which, in the case of $C_5$–$C_6$ hydrocarbons will move the reaction equilibrium toward the production of isoparaffins. The cooling is particularly beneficial for the arrangement of this invention where exothermic reactions can raise the temperature of the reaction zone effluent above those that are most beneficial for adsorption.

Whether operating with one or more reactors the effluent from the isomerization zone will in most cases enter a separation zone for the removal of light gases from the isoparaffin containing product stream. The light gases include hydrogen added to the feed stream entering the first conversion zone and any additional hydrogen that was added to the feed entering the second conversion zone. At minimum, the separation facilities divide the conversion zone effluent into a product stream comprising $C_4$ and heavier hydrocarbons and a gas stream which is made up of lighter hydrocarbons and hydrogen. Suitable designs for rectification columns and separator vessels are well known to those skilled in the art. The separation section may also include facilities for recovery of normal alkanes. Normal alkanes recovered from the separation facilities may be recycled to either the first or second conversion zone to increase the conversion of normal alkanes to isoalkanes. $C_3$ and lighter hydrocarbons and any excess hydrogen from the second conversion zone are removed or returned to the process as part of the hydrogen gas stream.

The type of separation zone and the hydrogen concentration in the effluent will influence the placement of the adsorption zone for the recovery of chloride compounds. Traditional isomerization processes operated with a relatively high recycle of hydrogen. In order to conserve hydrogen and stabilize the effluent, the effluent from the isomerization zone will pass directly to a hydrogen separator when the hydrogen to hydrocarbon ratio exceeds about 0.05. Cooling ahead of the hydrogen separator will lower the remainder of the effluent stream to a temperature in a range of from 80°–140° F. Thus, the temperature condition of the effluent leaving the hydrogen separator is suitable for adsorption of chloride compounds. Where there is a hydrogen recycle, the chloride adsorber bed undergoing the adsorption step will normally receive the effluent stream passing from the hydrogen separator to a stabilizer for the separation of isomerate product from non-condensibles. Isomerization zone processes that operate with very low hydrogen concentrations in the feed and the effluent eliminate the separator and an accompanying recycle compressor to reduce utility and capital cost. In these cases, the effluent stream passes directly from the isomerization reaction zone to the stabilizer. In most cases, the temperature of the effluent passing from the isomerization reaction zone to the stabilizer exceeds a suitable adsorption temperature. Therefore, where the isomerization reaction zone operates without hydrogen recycle, or in what is generally referred to as a hydrogen once-through operation, the effluent from the isomerization zone is cooled to place the chloride adsorber between the reactor and the stabilizer or the chloride adsorber generally adsorbs chloride compounds from the overhead of the stabilizer. Since most of the chloride compounds are contained in the stabilizer overhead, the isomerate from the stabilizer is still relatively free of chloride compounds and a majority of the chlorides are recovered for return to the isomerization reaction zone.

Again, it is generally known that high chlorided platinum-alumina catalysts of this type are highly sensitive to sulfur and oxygen-containing compounds. A sulfur concentration of 0.5 ppm in the feed or less is required, since the presence of sulfur in the feedstock serves to temporarily deactivate the catalyst by platinum poisoning. Activity of the catalyst may be restored by hot hydrogen stripping of sulfur from the catalyst composite or by lowering the sulfur concentration in the incoming feed to below 0.5 ppm so that the hydrocarbon will desorb the sulfur that has been adsorbed on the catalyst. Water and oxygenate compounds are generally kept to a concentration of 0.1 ppm or less. The more stringent limitation on water and oxygenate compounds that decompose to form water stems from the fact that water can act to permanently deactivate the catalyst by removing high activity chloride from the catalyst and replacing it with inactive aluminum hydroxide.

Although sulfur compounds will not cause permanent deactivation, isomerization feeds will usually contain sulfur which will interfere with the isomerization operations. Sulfur contaminants are present with the original crude oil fraction and include mercaptans, sulfides, disulfides and thiophenes. For light straight run feeds, sulfur concentrations will usually range from 20–300 ppm. Rapid coking of the catalyst has been experienced in most cases following sulfur deactivation. If left unchecked, the coking will be severe enough to require a complete regeneration of the catalyst. Therefore, it is common practice to minimize the amount of sulfur that contacts catalyst in the isomerization zone to prevent deactivation and avoid a full regeneration of the catalyst.

The organo-sulfur compounds present in many hydrocarbon feed streams can be removed from hydrocarbon fractions by the use of hydrotreatment. Hydrotreatment feedstocks containing organo-sulfur compounds, such as mercaptans, sulfides, disulfides and thiophenes, are reacted with hydrogen to produce hydrocarbons and hydrogen sulfides. The desulfurization of the hydrocarbons in the hydrotreater is basically a hydrogenation process. Although the hydrotreating process effectively converts and removes sulfur compounds, it adds significant costs to the operation of an isomerization system.

Certain embodiments of this invention can use an adsorption zone to remove sulfur compounds ahead of the isomerization reaction zone. In one arrangement (disclosed in U.S. Pat. No. 4,831,206) the sulfur adsorption zone adsorbs sulfur from the feed entering the isomerization reactor and desorbs sulfur from the adsorption zone into the adsorption zone effluent stream.

A wide variety of adsorbents can be used for removing the sulfur from the feed. Suitable adsorbents for hydrogen sulfide include those adsorbents having a pore diameter of at least 3.6 Å, the kinetic diameter of hydrogen sulfide. Such adsorbents include Zeolite 5A Zeolite 13X, activated carbon and other materials that are well known in the an and conventionally used for hydrogen sulfide adsorption. Particularly preferred adsorbents for the removal of hydrogen sulfide from the isomerization zone feedstream include 4A Zeolite and clinoptilolite molecular sieves. Zeolite 4A is the sodium form of Zeolite A and has pore diameters of about 4 Å. The method for its preparation and chemical and physical properties are described in detail in U.S. Pat. No. 2,882,243 the contents of which are hereby incorporated by reference.

In order to demonstrate the operation of this invention, an isomerization reaction zone using a chlorided platinum alumina catalyst operated with a sulfur containing feedstream and a recycle of hydrogen is depicted in FIG. 1. FIG. 1 shows the process for the isomerization of a sulfur bearing feedstream that contains less than 100 ppm of organic sulfur compounds. FIG. 1 is a schematic representation of the process and shows only the portions of the major equipment necessary to carry out the process. Other related equipment such as separators, pumps, compressors, etc. are well known to those skilled in the art and are not necessary for an understanding of Applicant's invention or the underlying concepts. This example is based on computer simulations and calculated results for the selective processing conditions.

EXAMPLE 1

In the isomerization process of FIG. 1, a hydrocarbon feedstream containing 4 to 7 carbon atoms and derived from a light naphtha feedstream enters the process through a line 10. The feed entering via line 10 also contains from 0 to 500 ppm of sulfur. The feed mixes with a recycle stream of light gases 12 comprising at least 50 wt. % hydrogen. Preferably, the hydrogen-containing gas stream will have a hydrogen concentration greater than 75 wt. % hydrogen. The hydrogen gas stream mixes with the isomerization feed in proportions that will produce a molar hydrogen to hydrocarbon ratio of from 0.5 to 2. Line 14 carries the feed mixture to a heater 16. The feed mixture exits heater 16 at a temperature of about 305° C. (580° F.) and enters a hydrotreater 18 via a line 20. Hydrotreater 18 converts organic sulfur compounds to hydrogen sulfide which leave the hydrotreater reactor with the feed via a line 22. After heat exchange with the incoming hydrotreater feed, (not shown) line 22 transports the hydrogen sulfide containing feedstream to an adsorber vessel 24. Adsorber bed 24 contains a 4A or A type adsorbent and operates in an adsorption stage to remove hydrogen sulfide from the feed. The hydrogen sulfide free feedstream passes via a line 26 to an adsorbent vessel 28 that contains barium cation-exchanged clinoptilolite adsorbent having capacity for the removal of chloride compounds. Adsorber vessel 28 operates in a desorption mode to desorb chloride compounds into a stream 30. A make-up stream 32 of hydrogen chloride mixes with the effluent from adsorbent vessel 28 to provide an isomerization zone feedstream having a hydrogen to hydrocarbon ratio of 1.0 carried via line 34. The isomerization zone feed enters an isomerization reactor vessel 36. The isomerization reactor vessel contains chlorided platinum alumina catalyst that contacts the feedstream and produces an isomerization zone product stream having the composition set forth in Table 2.

TABLE 2

| Component | Mole Percent |
|---|---|
| HCl | 0.03 |
| Hydrogen | 4.12 |
| Methane | 4.79 |
| Ethane | 2.76 |
| Propane | 4.69 |
| Isobutane | 4.00 |
| Normal Butane | 1.88 |
| Isopentane | 16.29 |
| Normal Pentane | 5.97 |
| Cyclopentane | 0.88 |
| 2,2 Dimethyle Butane | 9.41 |
| 2,3 Dimethyl Butane | 4.17 |
| 2 Methanyl Pentane | 13.58 |
| 3 Methanyl Pentane | 8.88 |
| Normal Hexane | 5.59 |
| Methyl Cyclopentane | 5.54 |
| Cyclohexane | 5.24 |
| Other | 2.18 |

Line 38 carries the effluent from isomerization zone 36 to stages of separation, desorption and adsorption. From line 38, the isomerization zone effluent first passes through a cooler 40, that lowers the effluent from a temperature of about 350° F. to a temperature of about 80° F. The effluent leaves the cooler and passes through line 42 to an adsorption vessel 44, operating in the adsorption mode, to adsorb HCl. Adsorption vessel 44 operates in cyclic fashion with adsorption vessel 28 and contains a similar adsorbent. The adsorbent in adsorbent vessel 44 adsorbs chloride compounds contained in the liquid effluent carried by line 42. In some cases the effluent carried by line 42 may be mixed phase. Where mixed phase flow is necessary it may be necessary to use an adsorbent vessel and adsobent that can accomodate a mixed phase flow or separtion of the mixed phase flow into separate adsorption zones that receive either liquid or vapor phase components.

An isomerization zone effluent fraction containing hydrogen sulfide and less than 1 ppm chlorides passes from adsorption vessel 44 to a separator 48 through line 46. A compressor 50 receives the overhead from separator 48 via a line 52, recompresses the effluent to a pressure of about 350 to 450 psig and passes the recompressed hydrogen-containing stream through a line 54 into admixture with a make-up hydrogen stream 56 which returns to the hydrotreater via line 12. A line 58 carries the liquid effluent from the bottom of separator 48 to the inlet of a pump 60. Pump 60 charges the remainder of the effluent fraction through a line 62 and into a stabilizer 64. Stabilizer 64 separates the effluent fraction into a bottoms stream 66. An isomerate product stream 70 comprising $C_4$ and heavier hydrocarbons is withdrawn from the process by line 70. A portion of the stream 70 is taken by a line 68 through a reboiler 72, and via a line 74 to an adsorption vessel 76. This adsorption vessel works cyclically with adsorber vessel 24. Adsorber vessel 76 is in the desorption mode to desorb the previously adsorbed sulfur compounds through line 78 back into the stabilizer with the reboiled liquid. An overhead stream 79 from the stabilizer contains $C_3$ and lower molecular weight gases including hydrogen sulfide. The overhead stream 79 may be further separated into a non-condensible flue gas stream and an LPG stream containing hydrogen sulfide.

EXAMPLE 2

Figure 2:
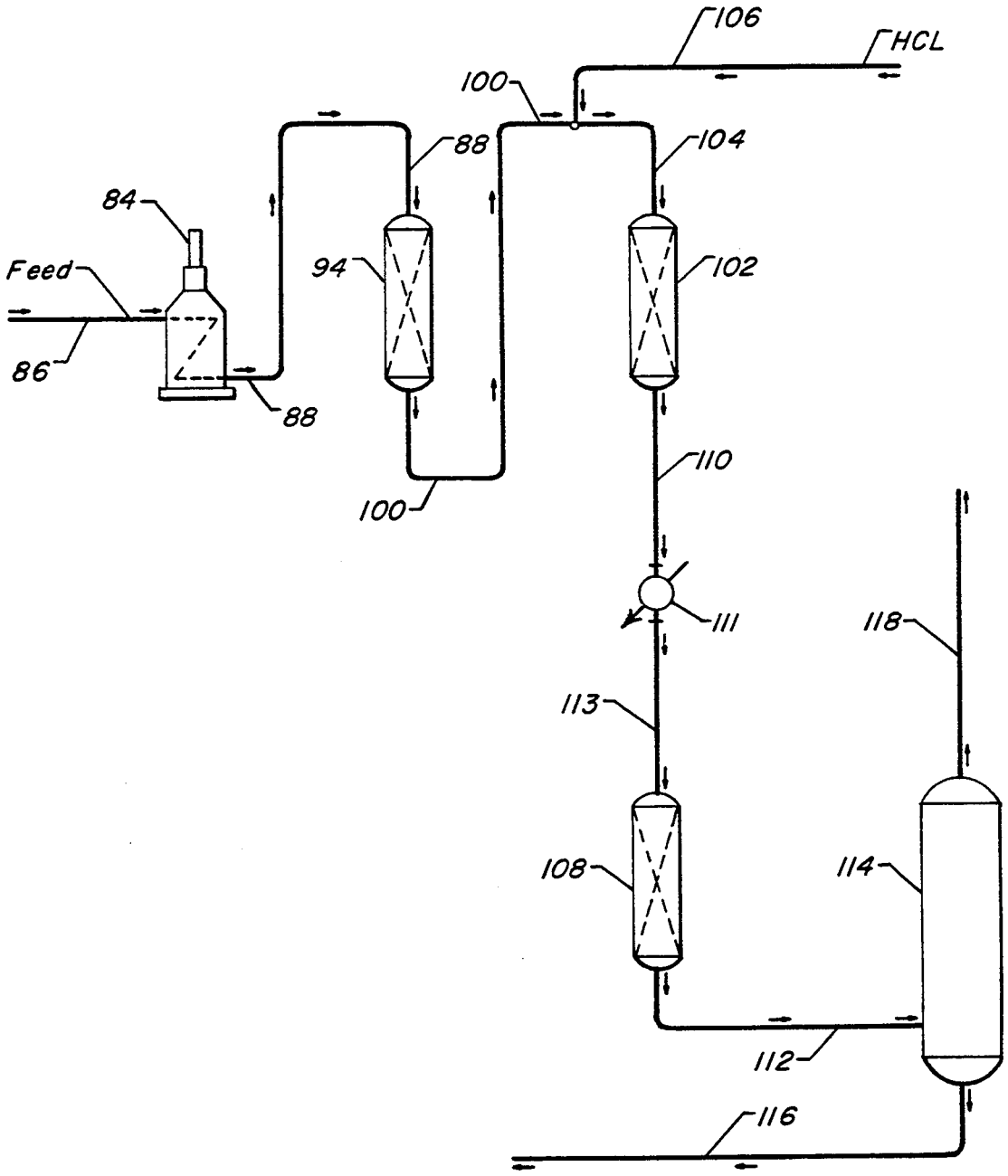
FIG. 2 shows a flow diagram for isomerizing a feed stream comprising hydrocarbons similar to that depicted in FIG. 1 but differing by the absence of hydrogen recycle and sulfur in the feed.

FIG. 2 exemplifies another operation of this invention wherein the process uses a low hydrogen concentration to provide a once-through utilization of hydrogen without the adsorption of sulfur and only the adsorption of HCl. Suitable hydrogen concentrations for this type of operation will have hydrogen to hydrocarbon molar ratios as low as 0.05. Again, a feedstream having the same composition as that described in FIG. 1 enters the process via a line 80. A line 82 injects hydrogen into the feedstream to produce a combined feed having a molar hydrogen to hydrocarbon ratio of about 0.05 that enters a heater 84 via a line 86. Feed then passes serially through a chloride adsorbent vessel 94 via line 88. Line 100 transports the effluent from the adsorbent vessel 94 into admixture with a chloride make-up stream from a line 106 before the feed flows into an isomerization reactor vessel 102 via a line 104. The chloride adsorbent vessel 94 ahead of the isomerization zone, as depicted in FIG. 2, operates in essentially the same manner as that depicted in FIG. 1.

Downstream of the isomerization reactor 102, the effluent at a temperature of about 300°–400° F. passes via a line 110 to a cooler 111 that lowers the effluent to a temperature of about 200° F. Line 113 carries the cooler effluent to an adsorption vessel 108 that operates in the adsorption mode to adsorb HCl. Adsorption vessel 108 operates in cyclic fashion with adsorption vessel 94 and contains a similar adsorbent. The adsorbent in the adsorbent vessel 108 adsorbs chloride compounds contained in the liquid effluent carried by line 113 down to a concentration of less than 1 ppm chlorides taken by an effluent line 112. Line 112 passes the effluent to a stabilizer vessel 114 that again separates the effluent into an isomerate product stream containing $C_4$ and heavier hydrocarbons and a light overhead stream. A line 116 carries the bottoms product stream from the process. The overhead taken via line 118 and consisting of $C_3$ and lighter gases, non-condensible gases and hydrogen sulfide passes out of the process and undergoes further separation or use as a fuel gas.

EXAMPLE 3

A series of tests were run to determine the adsorption capacity of a number of clinoptilolite adsorbents for hydrogen chloride and hydrocarbons. The following examples are provided for illustrative purposes and are not intended to limit the scope of the claims which are set forth below.

Sample 1- Na K-Clinoptilolite

Ore for this sample was obtained from a source having Na and K cation concentrations naturally in a preferred range of 25 to 85% sodium and 15 to 75% potassium at cation exchange sites. The ore of this sample contains about 50% sodium and 36% potassium cations which is well within the preferred range for recycling HCl. Before using the ore of Sample 1, it was washed with liberal amounts of water to remove soluble debris. The chemical analysis of the sample is given in Table 3.

Sample 2- Mg K - Clinoptilolite

Sample No. 2 was prepared from another clinoptilolite ore that underwent ion-exchange with a mixed solution of NaCl and KCl at 95° C. The concentration of NaCl was 2M and the concentration of KCl was 0.4M. The amount of NaCl salt used was 20 times the total ion-exchange capacity of the ore. The amount of KCl used was four times the total ion-exchange capacity of the ore. The sample was put in a steel-jacked column and the column was maintained at 95° C. The mixed solution was preheated to 95° C. and pumped through the column for a period of 6 hours. The product was washed with 10 bed volumes of water at 95° C. The product was ion-exchanged in the column with a 0.33M $MgCl_2$ solution at 95° C. The amount of $MgCl_2$ salt used was equal to four times the total ion-exchange capacity of the ore. The contact time between the $MgCl_2$ solution and clinoptilolite was about 4 hours. The product was then washed with about 10 bed volumes of hot water.

Sample 3- A.W. Clino

Sample 3 is an acid washed (leached) clinoptilolite. It was prepared by placing 2000 gm of 8×12 meshed ore in a glass column. The glass column was maintained at 90° C. with a heating tape. About 20 liters 2.4N HCl was maintained at 90° C. in a glass flask by a heating mantle. The HCl was circulated through the column recycling at a flow rate about 300 ml/min. The acid leaching process was continued for about 40 hours. The product was washed with about 26 liter of water at 90° C. in a period of two hours. The chemical analysis of this sample is given in Table 3.

Sample 4- Acid Washed $NH_4$-Clinoptilolite

To prepare Sample 4, 8×12 meshed ore clinoptilolite was ion-exchanged in a glass column at 90° C. with a 0.68 $NH_4Cl$ solution by pumping through a quantity of the solution which contained salt equal to four times the total ion-exchange capacity of the adsorbent used. The product was washed with 10 bed volumes of water. 300 gm of the washed product was suspended in 1 liter of an 80° C. 6N HCl solution and stirred for 4 hours. The acid washed product was afterward washed with water until the product was free of HCl.

Sample 5-A.W. Clino

Sample 5 was prepared from a clinoptilolite ore that was washed with 2N HCl at room temperature in a glass column by pumping 20 bed volumes of the HCl solution through the column in 2 hours. The product was washed with 20 bed volumes of water for 2 hours. The chemical analysis of the sample is given in Table 3.

Sample 6 - A.W. Ba-Clino

Sample 6 is an acid washed clinoptilolite for ore that was barium ion-exchanged and prepared as follows: About 60 lb of 8×12 meshed ore was loaded into a steam jacketed stainless steel column. It was washed with a mixed solution of 0.3N HCl and 2N NaCl at 60° C. The solution to zeolite ratio was about 25 ml/gm of zeolite. The solution was recycled at a rate of about 18 gal/min for 2 hours. After the acid washing was completed, the column was drained and the ore sample was washed with approximately 10 bed volumes of a 0.01N NaCl solution at 90° C. The acid washed sample was further ion-exchanged with 2N $BaCl_2$ at a pH of 8 at 90° C. The total $BaCl_2$ content in the solution was about four times the total ion-exchange capacity of the zeolite sample. The solution was pumped through the column in a period of 6 hours. The ion-exchanged sample was then washed with approximately 10 bed volumes of a 0.01N $BaCl_2$ solution at about 90° C. The washed product was then dried and calcined at 550° C. The result of chemical analysis of the sample is given in Table 3.

TABLE 3

| | Sample Anaylsis | | | | | |
|---|---|---|---|---|---|---|
| Sample No. | 1 | 2 | 3 | 4 | 5 | 6 |
| Wt. % dry basis | | | | | | |
| $SiO_2$ | 75.9 | 77.3 | 87.8 | 86.9 | 81.6 | 73.6 |
| $Al_2O_3$ | 12.6 | 12.8 | 11.8 | 11.04 | 13.03 | 11.6 |
| BaO | — | — | — | — | — | 12.6 |
| MgO | 0.49 | 2.4 | 0.12 | .19 | 0.31 | 0.26 |
| CaO | 1.20 | 0.75 | 0.26 | .12 | 0.53 | 0.22 |
| $Na_2O$ | 3.91 | 1.4 | 0.38 | .26 | 0.85 | 0.42 |
| $K_2O$ | 4.33 | 3.9 | 0.48 | .36 | 3.3 | 1.16 |
| $Fe_2O_3$ | 0.94 | 0.72 | 0.87 | .54 | 0.85 | 0.71 |
| SrO | — | — | — | — | — | — |
| $(NH_4)_2O$ | — | — | — | 1.68 | — | — |
| Total | 100.00 | 100.00 | 100.00 | 100.00 | 100.00 | 100.00 |
| Cation Concentration mmol/gm | | | | | | |
| Si | 12.7 | 12.8 | 14.6 | 14.5 | 13.6 | 12.3 |
| Al | 2.48 | 2.5 | 2.3 | 2.17 | 2.6 | 2.3 |
| Ba | — | — | — | — | — | 0.83 |
| Mg | .12 | 0.60 | 0.03 | 0.05 | 0.08 | 0.07 |
| Ca | .22 | 0.13 | 0.05 | 0.02 | 0.09 | 0.04 |
| Na | 1.26 | 0.45 | 0.12 | 0.84 | 0.27 | 0.13 |
| K | 0.92 | 0.83 | 0.10 | 0.08 | 0.71 | 0.24 |
| Sr | — | 0.09 | 0.01 | — | 0.11 | 0.09 |
| $NH_4$ | — | — | — | 0.67 | — | — |

EXAMPLE 4

Adsorbent Screening for Hydrogen Chloride Adsorption

To measure the reversible HCl adsorption capacity of clinoptilolites, a McBain Bakker quartz balance was used. The description of a McBain Bakker balance is described in detail in "*Physical Adsorption of Gases*" by Young & Crowell, published by Butterworth in 1962. Samples tested were first vacuum activated at 400° C. for 16 hours to remove any adsorbed moisture. Then the HCl adsorption isotherms from 1 to 25 torr were measured. The samples were then kept at 25 torr HCl for 1 hour. The samples were next vacuum activated at 180° C. over night. After that, the HCl isotherms of the samples were again measured. In some cycles, at the end of isotherm measurement, the HCl pressure was raised to 400 torr and maintained at that pressure for several hours as an extra HCl treatment to test the acid stability of the adsorbent. After treatment, the samples were reactivated at 180° C. over night. The procedure was repeated nine times.

Figure 3:
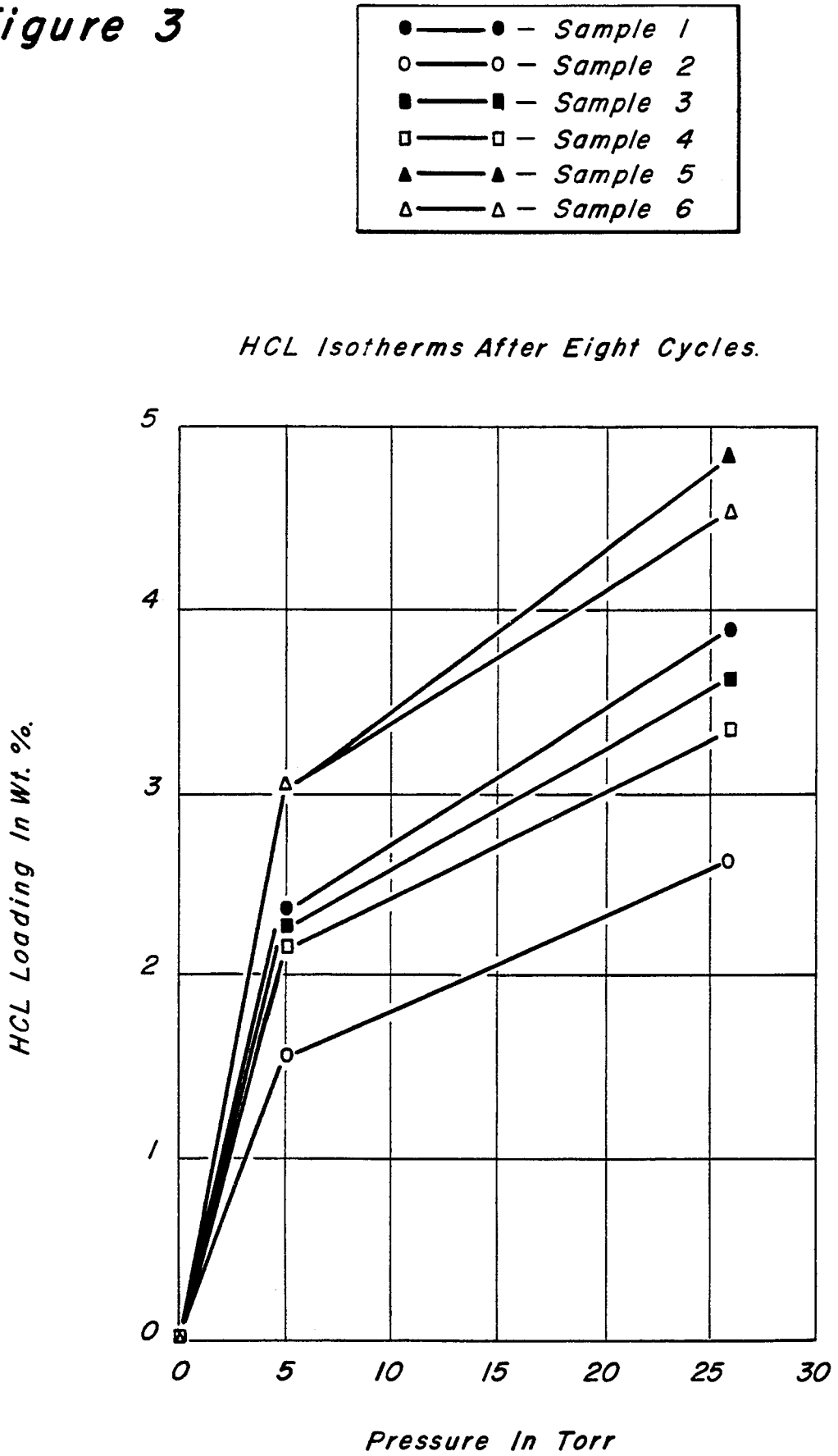
FIG. 3 is a graph showing the capacity of various adsorbents for HCl adsorption.

FIG. 3 shows isotherms of the tested samples following eight of the above described cycles. After eight cycles, every adsorbent retained sufficient capacity of HCl to be useful as an adsorbent for HCl recycle in a catalytic process.

Figure 4:
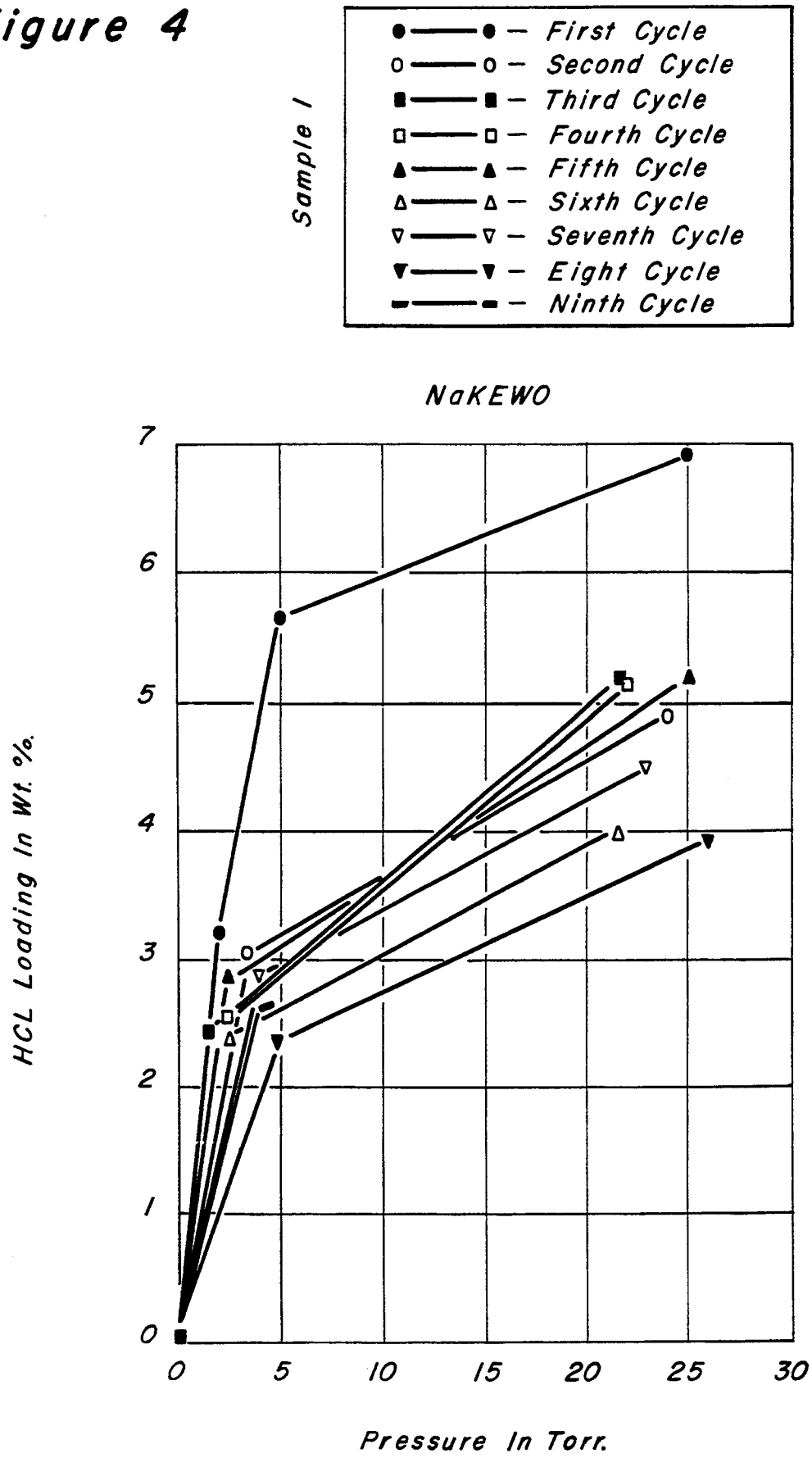
FIG. 4 is a graph showing the capacity stability of an HCl adsorbent.

FIG. 4 shows HCl isotherms of Sample 1 after each adsorption desorption cycle. The data shows that there was a large drop after the first cycle, but after that, the HCl capacity stabilized. 400 torr HCl was applied in the seventh cycle which caused a further depression of the HCl isotherm in eighth cycle. After the eighth cycle, only 26 torr HCl was applied and the HCl capacity in the ninth cycle rebounded.

Figure 5:
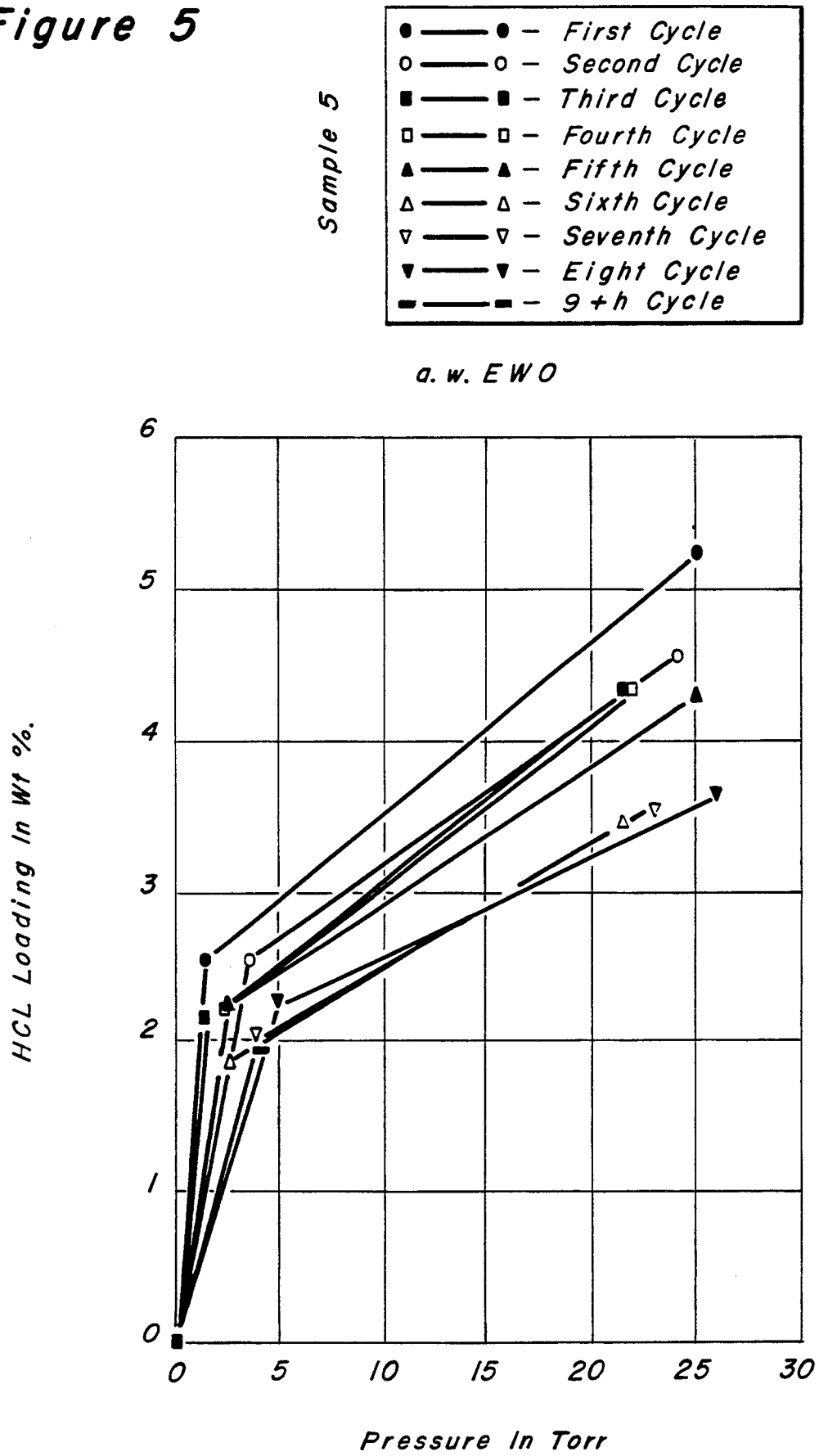
FIG. 5 is a graph showing the capacity stability of another HCl adsorbent.

FIG. 5 shows the HCl isotherm of Sample 5 which was a severely HCl extracted clinoptilolite. This material shows a much lower initial HCl isotherm. However, the capacity loss of the sample after the HCl adsorption desorption cycles is also much less and it reached final steady state adsorption capacity after six cycles.

EXAMPLE 5

Figure 6:
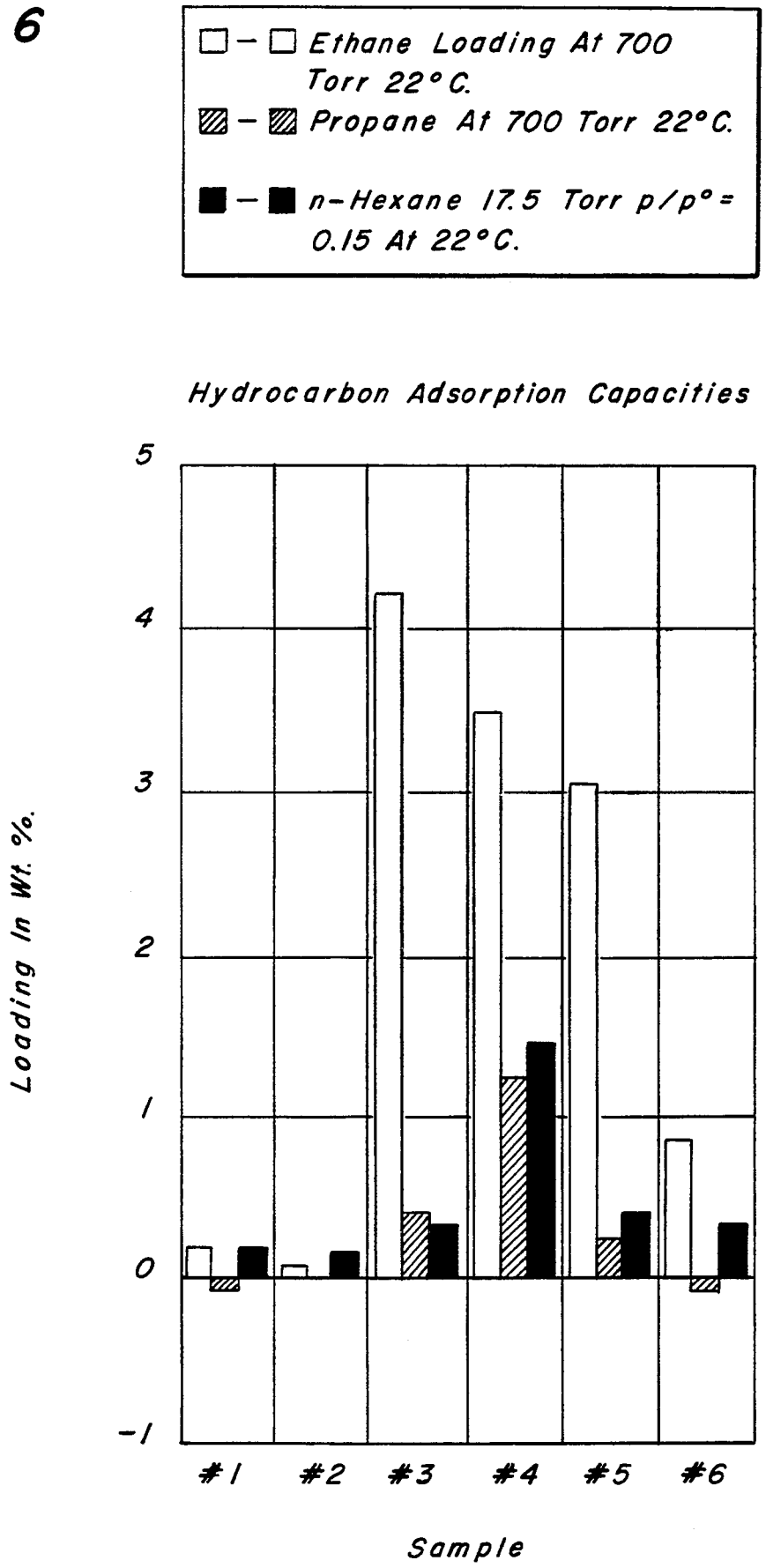
FIG. 6 is a graph showing the hydrocarbon adsorption capacity of several adsorbents.

To further establish the suitability of the samples as adsorbents for HCl adsorption, a series of experiments were run to determine the hydrocarbon adsorption capacity of each of the samples. The McBain Bakker balance was again used to measure the hydrocarbon adsorption capacities of selected clinoptilolites at room temperature. Three hydrocarbons were used: ethane at 700 torr; propane at 700 torr; and n-hexane at 17.5 torr. The results of these test are presented graphically in FIG. 6 where the percentage loading of the tested hydrocarbons are presented for each sample. As the data demonstrates half of the samples had very small hydrocarbon adsorption capacities. NaK, MgK clinoptilolite (Samples 1 and 2) have essentially no capacity for any of the three hydrocarbons and are, therefore, the most preferred adsorbents. Moreover sample 1, the sodium and potassium exchanged clinoptilolite, is especially preferred in view of its good HCl capacity and low hydrocarbon capacity. Add washed clinoptilolite (Samples 3 and 5) and acid washed Ba clinoptilolite (Sample 6) have low propane and n-hexane capacity and are, therefore, potentially useful adsorbents. Acid washed $NH_4$ clinoptilolite has significant capacity for all three hydrocarbons, therefore, co-adsorption problems are likely to result and it is not expected to function well as an adsorbent.

Aside from isomerization and chloride compound adsorption, another process in which this invention is useful is the dehydrogenation of paraffinic hydrocarbons. In a typical dehydrogenation process a feed stream rich in $C_3$ and/or $C_5$ hydrocarbons enters a reaction zone and is contacted with a dehydrogenation catalyst at dehydrogenation conditions. The dehydrogenation zone may use any suitable dehydrogenation catalyst. Generally, the preferred catalyst comprises a platinum group component, an alkali metal component, and a porous inorganic carrier material. The catalyst may also contain promoter metals which advantageously improve the performance of the catalyst. It is preferable that the porous carrier material of the dehydrogenation catalyst be an adsorptive high surface area support having a surface area of about 25 to about 500 $m^2/g$. The porous carrier material should be relatively refractory to the conditions Utilized in the reaction zone and may be chosen from those carrier materials which have traditionally been utilized in dual function hydrocarbon conversion catalysts. A porous carrier material may, therefore, be chosen from an activated carbon, coke or charcoal, silica or silica gel, clays and silicates including those synthetically prepared and naturally occurring, which may or may not be acid-treated as, for example, attapulgus clay, diatomaceous earth, kieselguhr, bauxite; refractory inorganic oxides such as alumina, titanium dioxide, zirconium dioxides, magnesia, silica alumina, alumina boria, etc.; crystalline alumina silicates such as naturally occurring or synthetically prepared mordenite or a combination of one or more of these materials. The preferred porous carrier material is a refractory inorganic oxide, with the best results being obtained with an alumina carrier material. The aluminas, such as gamma alumina, give the best results in general. The preferred catalyst will have a gamma alumina carrier which is in the form of spherical particles having relatively small diameters on the order of about 1/10 inch.

The preferred dehydrogenation catalyst also contains a platinum group component. Of the platinum group metals, which include palladium, rhodium, ruthenium, osmium and iridium, the use of platinum is preferred and palladium is the next preferred. The platinum group component may exist within the final catalyst composite as a compound such as an oxide, sulfide, halide, oxysulfide, etc., or an elemental metal or in combination with one or more other ingredients of the catalyst. It is believed that the best results are obtained when substantially all the platinum group components exist in the elemental state. The platinum group component generally comprises from about 0.01 to about 2 wt. % of the final catalytic composite, calculated on an elemental basis. It is preferred that the platinum content of the catalyst be between about 0.1 and 1 wt. %. The platinum group component may be incorporated into the catalyst composite in any suitable manner such as by coprecipitation or cogelation with the preferred carrier material, or by ion-exchange or impregnation of the carrier material. The preferred method of preparing the catalyst normally involves the utilization of a water-soluble, decomposable compound of a platinum group metal to impregnate the calcined carrier material. For example, the platinum group component may be added to the support by commingling the support with an aqueous solution of chloroplatinum or chloropalladic acid. An acid such as hydrogen chloride is generally added to the impregnation solution to aid in the distribution of the platinum group component throughout the carrier material.

Additionally, the preferred catalyst contains an alkali metal component chosen from cesium, rubidium, potassium, sodium, and lithium. The preferred alkali metal is normally either potassium or lithium, depending on the feed hydrocarbon. The concentration of the alkali metal may range from about 0.1 to 5 wt. %, but is preferably between 1 and about 4 wt. % calculated on an elemental basis. This component may be added to the catalyst by the methods described above as a separate step or simultaneously with the solution of another component. With some alkali metals, it may be necessary to limit the halogen content to less than 0.5 wt. % and preferably less than 0.1 wt. %, while others may have higher halogen content.

As noted previously, the dehydrogenation catalyst may also contain promoter metal. One such preferred promoter metal is tin. The tin component should constitute about 0.01 to about 1 wt. % tin. It is preferred that the atomic ratio of tin to platinum be between 1:1 and about 6:1. The tin component may be incorporated into the catalytic composite in any suitable manner known to effectively disperse this component in a very uniform manner throughout the carrier material. Thus, the component may be added to the carrier by coprecipitation.

A preferred method of incorporating the tin component involves coprecipitation during the preparation of the preferred carrier material. This method typically involves the addition of a suitable soluble tin compound, such as stannous or stannic chloride to an alumina hydrosol, mixing these ingredients to obtain a uniform distribution throughout the sol and then combining the hydrosol with a suitable gelling agent and dropping the resultant admixture into an oil bath. The tin component may also be added through the utilization of a soluble decomposable compound of tin to impregnate the calcined porous carrier material. A more detailed description of the preparation of the carrier material and the addition of the platinum component and the tin component to the carrier material may be obtained by reference to U.S. Pat. No. 3,745,112.

Dehydrogenation can occur over a wide range of conditions that include temperatures of from 400° to 900° F. and pressures of up to 10 atmospheres. The catalyst may be arranged in a fixed bed or a moving bed arrangement to contact the feed. A preferred catalyst comprises platinum, tin and gallium on a refractory inorganic oxide support and, along with operating conditions and dehydrogenation process arrangement is taught in the previously referenced U.S. Pat. No. 4,786,625 and in U.S. Pat. No. 5,087,792 the contents of which are hereby incorporated by reference.

In addition to the metal modifiers, the catalyst also contains a sulfur component which acts as a catalyst modifier to improve catalyst performance. The sulfur can be added initially to the catalyst or the dehydrogenation unit can operate with continual sulfur addition. Typical sulfur compounds for incorporation in to the catalyst comprise hydrogen sulfide and lower molecular weight mercaptans. The sulfur component can comprise from 0.01 to 2 wt %, calculated on an elemental basis, of the catalytic composite. Even where the formulation of the catalyst incorporates sulfur during the manufacture of the catalytic composite, continual or intermittent sulfur addition during operation can benefit the dehydrogenation process by adjusting the sulfur level or replacing sulfur as it is lost from the reaction zone.

To maintain the sulfur level this further embodiment of the invention contacts the effluent from the dehydrogenation zone with a sulfur adsorbent. The sulfur adsorbent can comprise any material capable of selectively removing sulfide compounds. For the adsorption of hydrogen sulfide, adsorbents include the adsorbents previously mentioned for adsorption of sulfur from the isomerization zone feed stream. The adsorbents which are particularly suitable in the process of this embodiment of the present invention and which are capable of providing good hydrogen sulfide removal at the temperatures employed in the adsorption cycle are 4A zeolite molecular sieve and clinoptilolite. Zeolite 4A is the sodium cation form of zeolite A and has pore diameters of about 4 angstroms. The method for its preparation and its chemical and physical properties are described in detail in previously referenced U.S. Pat. No. 2,882,243.

Other adsorbents which are also applicable in this embodiment of the present invention include those adsorbents which have a pore size of at least 3.6 Å, the kinetic diameter of hydrogen sulfide. Such adsorbents include zeolite 5A, zeolite 13X, activated carbon, and the like. Such adsorbents are well known in the art and are conventionally used for hydrogen sulfide.

In a preferred process arrangement a feed stream of $C_4$ hydrocarbons enters the process where it is combined with a hereinafter described recycle stream. The feed stream is rich in saturated $C_4$ hydrocarbons. A high concentration of saturated hydrocarbons is preferred to increase the conversion within the hereinafter described dehydrogenation zone. Ordinarily, this feed stream will contain some mixture of isobutane and normal butane. Typical sources for this feed stream are field butanes and other $C_4$ hydrocarbon streams including refinery saturated butanes.

The combined recycle stream and feed stream enter a sulfur adsorption vessel. Hot combined feed desorb sulfur in the form of $H_2S$ from a clinoptilolite adsorbent in the adsorption vessel. After a period of time the adsorption vessel switches function from desorption of the combined stream to adsorption of sulfur compounds from the dehydrogenation effluent stream and is replaced by another adsorption vessel that has operated on the dehydrogenation zone effluent in the adsorption mode.

The combined recycle stream and feed stream with desorbed sulfur enter a dehydrogenation zone. The dehydrogenation zone of this invention can consist of any dehydrogenation process for the production of olefins from saturated $C_{3-C4}$ hydrocarbons. Preferably, the dehydrogenation process will produce only monoolefins. It is also preferred that the dehydrogenation zone be capable of converting at least 50% of the saturated hydrocarbons passing therethrough to monoolefins. A relatively high saturate conversion in the dehydrogenation specification reduces the necessary downstream separation facilities.

Along with the $C_4$ dehydrogenatable hydrocarbons, the feed to the dehydrogenation zone of the present invention comprises an $H_2$ rich stream, preferably containing at least 75 mol % $H_2$. The presence of $H_2$ within the dehydrogenation zone serves several purposes. First, the $H_2$ acts to suppress the formation of hydrocarbonaceous deposits on the surface of the catalyst, more typically known as coke. Secondly, $H_2$ can act to suppress undesirable thermal cracking. Because $H_2$ is generated in the dehydrogenation reaction and comprises a portion of the effluent, the $H_2$ rich stream introduced into the reaction zone generally comprises recycle $H_2$ derived from separation of the dehydrogenation zone effluent. Alternately, the $H_2$ may be supplied from suitable sources other than the dehydrogenation zone effluent. The preferred embodiment of the dehydrogenation process uses internally recirculated hydrogen and separates excess hydrogen for withdrawal from the process.

The dehydrogenatable hydrocarbon stream and $H_2$ stream are introduced into a dehydrogenation reaction zone. The dehydrogenation reaction zone of this invention preferably comprises at least one radial flow reactor through which the catalytic composite gravitates downwardly to allow a substantially continuous replacement of the catalyst with fresh and/or regenerated catalyst. A detailed description of the moving bed reactors herein contemplated may be obtained by reference to U.S. Pat. No. 3,978,150. The dehydrogenation reaction is a highly endothermic reaction which is typically effected at low (near atmospheric) pressure conditions. The precise dehydrogenation temperature and pressure employed in the dehydrogenation reaction zone will depend on a variety of factors such as the composition of the paraffinic hydrocarbon feedstock, the activity of the selected catalyst, and the hydrocarbon conversion rate. In general, dehydrogenation conditions include a pressure of from about 0 to about 35 bars and a temperature of from about 480° C. (900° F.) to about 760° C. (1400° F.). The $C_4$ hydrocarbons are charged to the reaction zone and contacted with the catalyst contained therein at a liquid hourly space velocity of from about 1 to about 10. Hydrogen, principally recycle hydrogen, is suitably admixed with the hydrocarbon feedstock in a mole ratio of from about 0.1 to about 10. Preferred dehydrogenation conditions, particularly with respect to $C_3$–$C_4$ paraffinic hydrocarbon feedstocks, include a pressure of from about 0 to about 20 bars and a temperature of from about 540° C. (1000° F.) to about 705° C. (1300° F.), a liquid hourly space velocity, of from about 1 to about 5, and a hydrogen/hydrocarbon mole ratio of from about 0.5 to about 2.

Effluent from the dehydrogenation reaction section passes through a sulfur adsorption vessel where sulfur compounds in the effluent stream are adsorbed and retained for desorption by the feedstream as previously described. The dehydrogenation zone effluent stream having a sulfur compound concentration of less than 1 ppm exits the dehydrogenation process.

We claim:

1. A process for the catalytic conversion of a feedstream comprising hydrocarbons in the presence of a beneficient material that enhances performance of the conversion zone, said process comprising, (a) contacting a first stream comprising hydrocarbons with a catalyst in a reaction zone in the presence of a beneficent material at hydrocarbon conversion conditions to convert hydrocarbons and produce a second stream comprising converted hydrocarbons and said material;

(b) passing at least a portion of said second stream to an adsorption zone containing an adsorbent having adsorption capacity for said material and contacting said second stream with said adsorbent at adsorption conditions, adsorbing said material on said adsorbent and producing an adsorption zone effluent stream having a reduced concentration of said material relative to said second hydrocarbon stream; and, (c) passing a hydrocarbon feedstream comprising hydrocarbons to said adsorption zone after adsorption of said material at desorption conditions to desorb said material from said adsorbent and produce at least a portion of said first stream.

2. The process of claim 1 wherein said material comprises a sulfur compound.

3. The process of claim 2 wherein said adsorbent is selected from the group consisting of molecular sieves, silica gels, activated carbon, and activated alumina.

4. The process of claim 2 wherein said process is a dehydrogenation process and said feedstream comprises hydrocarbons having from 3 to 5 carbon atoms.

5. The process of claim 1 wherein said material comprises a chloride compound.

6. The process of claim 5 wherein said adsorbent is a clinoptilolite molecular sieve.

7. The process of claim 5 wherein said process is an isomerization process and said feedstream comprises hydrocarbons having from 4 to 6 carbon atoms.

8. The process of claim 1 wherein said material is soluble in said feedstream.

9. The process of claim 1 wherein said adsorption zone recovers at least 90 wt. % of said material from said effluent stream.

10. The process of claim 1 wherein said adsorption zone recovers at least 99 wt. % of said material from said effluent stream.

11. A process for the isomerization of a hydrocarbon feed containing normal hydrocarbons with a chloride promoted catalyst, said process comprising:

(a) passing a first stream comprising normal hydrocarbons through a chloride adsorption zone containing an adsorbent for the adsorption of a chloride containing compound at desorption conditions and desorbing a chloride containing compound into said first stream to produce a second stream containing normal hydrocarbons and a chloride compound;

(b) passing said second stream to an isomerization reaction zone and contacting said second stream with a chloride promoted isomerization catalyst at isomerization conditions to convert normal hydrocarbons to non-normal hydrocarbons and producing an isomerization zone effluent stream;

(c) passing at least a portion of said isomerization zone effluent stream to said chloride adsorption zone containing an adsorbent for the adsorption of said chloride compound and adsorbing said chloride compound from said effluent stream for desorption in step a; and, (d) recovering a third stream from said adsorption of step (c) having a reduced concentration of chloride compounds relative to said effluent stream.

12. The process of claim 11 wherein said first stream contains paraffinic hydrocarbons.

13. The process of claim 11 wherein said effluent stream is cooled before entering said adsorption zone in step c.

14. The process of claim 11 wherein said effluent stream is separated into a heavy fraction and a light fraction comprising $C_3$ hydrocarbons and lower boiling materials and said light fraction enters the adsorption zone in step (c).

15. The process of claim 11 wherein said first stream or said second stream passes through a sulfur adsorption zone for the adsorption of a sulfur compound before entering said reaction zone and at least a portion of said effluent stream or said third stream passes through said sulfur adsorption zone for the desorption of said sulfur compound.

16. The process of claim 13 wherein said first stream passes through said a sulfur adsorption zone for the adsorption of sulfur and after passing through said chloride adsorption zone said third stream passes through said sulfur adsorption zone for the desorption of said sulfur compound.

17. The process of claim 16 wherein the effluent from said sulfur adsorption zone passes from said sulfur adsorption zone into a separator, and said separator removes non-condensible gases from said third stream.

18. The process of claim 14 wherein said first stream passes through a sulfur adsorption zone for the adsorption of sulfur compounds and said effluent stream passes through a sulfur adsorption zone for the desorption of sulfur compounds.

19. The process of claim 11 wherein the adsorbent having capacity for a chloride compound is selected from the group consisting of Na and K, Mg and K and barium ion-exchanged clinoptilolite, silicalite and silicagel.

20. The process of claim 11 wherein said chloride promoted catalyst comprises a chlorided platinum alumina catalyst.

21. The process of claim 11 wherein said chloride adsorption zone removes at least 90 wt. % of said chloride compound from said chloride adsorption zone.

22. The process of claim 11 wherein said chloride adsorption zone removes at least 99 wt. % of said chloride compound from said chloride adsorption zone.

* * * * *